US006701821B2

(12) United States Patent
Lundqvist et al.

(10) Patent No.: US 6,701,821 B2
(45) Date of Patent: Mar. 9, 2004

(54) WEAPON TURRET INTENDED FOR A MILITARY VEHICLE

(75) Inventors: Malin Lundqvist, Domsjo (SE); Jan Möller, Domsjo (SE)

(73) Assignee: Alvis Hagglunds Aktiebolag, Ornskoldsvik (SE)

( * ) Notice: Subject to any disclaimer, the term of this patent is extended or adjusted under 35 U.S.C. 154(b) by 0 days.

(21) Appl. No.: 10/245,275

(22) Filed: Sep. 18, 2002

(65) Prior Publication Data

US 2003/0051599 A1 Mar. 20, 2003

(30) Foreign Application Priority Data

Sep. 18, 2001 (SE) ..... 0103095

(51) Int. Cl.[7] ..... F41A 23/24
(52) U.S. Cl. ..... 89/37.03; 89/37.01
(58) Field of Search ..... 89/37.02, 37.03, 89/37.01, 40.03

(56) References Cited

U.S. PATENT DOCUMENTS 4,092,900 A * 6/1978 Hottinger et al. ..... 89/33.1
4,108,045 A * 8/1978 Herbst ..... 89/36.13
4,114,512 A * 9/1978 Schwendt ..... 89/36.13
4,346,644 A * 8/1982 De Haven et al. ..... 89/37.03
4,381,693 A * 5/1983 Dumez ..... 89/36.13
4,733,596 A * 3/1988 Crow et al. ..... 89/34
4,840,108 A * 6/1989 Hurlemann et al. ..... 89/33.14
5,095,803 A * 3/1992 Allais et al. ..... 89/40.03
5,187,317 A * 2/1993 Pellarin et al. ..... 89/36.14

FOREIGN PATENT DOCUMENTS

GB GB 2140537 A * 11/1984 ..... F41H/7/12

* cited by examiner

*Primary Examiner*—Michael J. Carone
*Assistant Examiner*—Troy Chambers
(74) *Attorney, Agent, or Firm*—Young & Thompson

(57) ABSTRACT

A weapon turret (10) intended for a military vehicle and equipped with a medium-calibre automatic weapon (12) and a relatively heavy-calibre weapon (14), in which the two weapons are, firstly, mounted in a weapon holder fitted in the weapon turret such that they can be jointly pivoted about a common horizontal pivot axis (18) and, secondly, can be pivoted jointly with the turret about a vertical centre axis (20) of the same, the heavy-calibre weapon (14) being mounted next to and parallel with the automatic weapon (12) and close up to this. At least one ammunition magazine (48) in the weapon turret (10) is provided with at least one guide duct (44, 46) for guiding an ammunition belt from the magazine to the automatic weapon (12). The automatic weapon (12) is mounted in the weapon holder such that the longitudinal axis of the barrel (26) of the automatic weapon extends through the common horizontal pivot axis (18) and through the vertical centre axis (20) of the weapon turret.

17 Claims, 3 Drawing Sheets

WEAPON TURRET INTENDED FOR A MILITARY VEHICLE

TECHNICAL FIELD

The present invention relates to a weapon turret intended for military vehicles, which is equipped with a medium-calibre automatic weapon, especially an automatic cannon, and a relatively heavy-calibre weapon, especially a shell launcher or cannon, in which the two weapons are, firstly, mounted in a weapon holder fitted in the weapon turret such that they can be jointly pivoted about a common horizontal pivot axis and, secondly, can be pivoted jointly with the turret about a vertical centre axis of the same, and in which at least one ammunition magazine is disposed in the weapon turret with guides for guiding ammunition belts from the magazine to the automatic weapon.

PRIOR ART

A combat vehicle having a weapon turret which is equipped with two weapons of essentially different calibre and can be pivoted according to the above is previously known; compare, for example, the Russian "BMP-3" combat vehicle. The weapon turret of this known combat vehicle supports in a common weapon holder, firstly, a 30 mm automatic cannon and, secondly, a 100 mm cannon. The two weapons are fitted in the weapon holder in such a way, however, that the longitudinal axes of the weapon barrels are situated on both sides of and equidistant from the vertical pivot or centre axis of the weapon turret, regarded in plan view. A problem is thereby created with respect to firing accuracy, especially for the automatic cannon, since, during automatic fire, the latter subjects the weapon turret to repeated torsional shocks about the vertical pivot axis.

In this known weapon turret, furthermore, the weapons have a relatively limited elevation capacity (max. ca. +60°) because of difficulties in directing the ammunition to these same, in a relatively limited space, via so-called flex ducts, which reduces the possibility of firing at a target with a plurality of heavy projectiles which simultaneously strike the target as a result of the shots being discharged as the elevation of the barrels progressively decreases. Moreover, the Russian vehicle is incapable of precision-firing when in motion, since the weapon turret lacks a gyro-stabilizing mechanism.

OBJECT AND SOLUTION OF THE INVENTION

One object of the present invention is to produce a weapon turret of the type stated in the introduction, which allows improved precision when firing automatic fire from an automatic cannon, both when stationary and in motion. For this object, the weapon turret according to the invention is characterized by the characteristics specified in the following independent Patent claim 1.

Another object is to produce a weapon turret which allows an enlarged range of elevation (>90°) for a multi-calibre weapon combination, in which the weapons are mounted about the same horizontal pivot axis in the weapon turret. Specific design characteristics required for this object are specified in the following contingent patent claims.

DETAILED DESCRIPTION OF A PREFERRED EMBODIMENT

Figure 1:
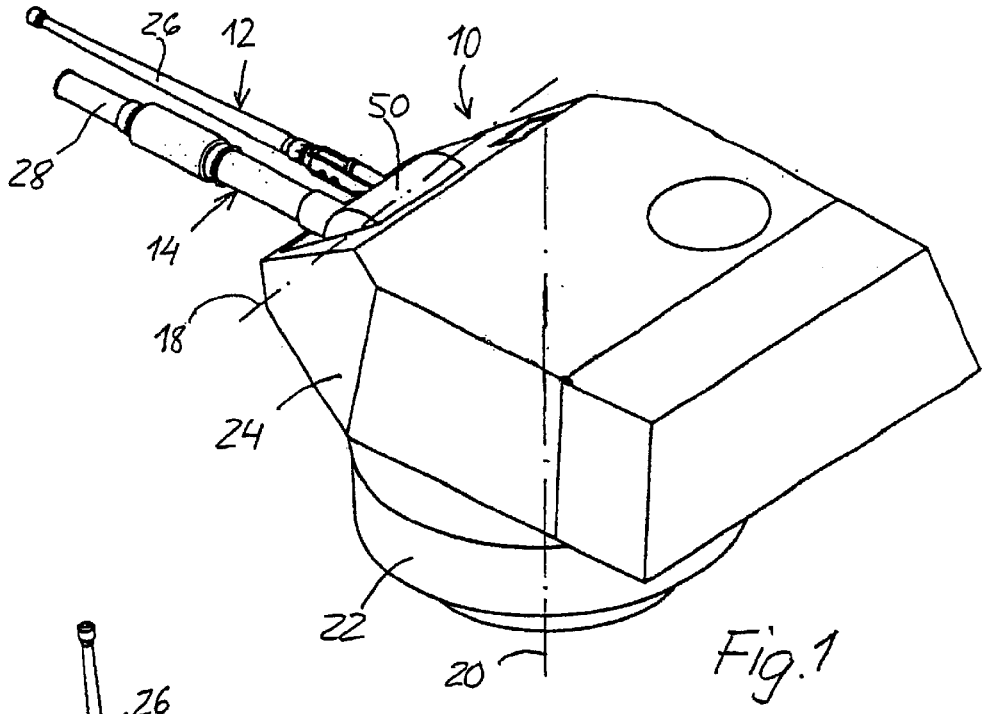
FIG. 1 is a perspective view of a weapon turret according to the invention, equipped with an automatic cannon and a shell launcher and in which the parallel-fitted barrels of the weapons assume an elevation of 0°.

In FIG. 1, a weapon turret according to the present invention, intended for military vehicles, is denoted in general terms by 10, which weapon turret is equipped with a medium-calibre automatic weapon in the form of an automatic cannon 12 and a relatively heavy-calibre weapon in the form of a shell launcher 14 (or cannon), in which the two weapons 12 and 14 are arranged parallel with each other and are mounted in a weapon holder fitted in the weapon turret 10 such that they can be jointly pivoted about a common horizontal pivot axis 18. The weapon turret 10 is, in turn, mounted in a vehicle (not shown) pivotably about a vertical centre axis 20. The weapon turret 10 comprises, firstly, a lower cage part 22, which accommodates, inter alia, an ammunition magazine for the heavy-calibre weapon 14 and seats for one or more operators and which is mounted in the body of the vehicle rotatably about the said axis 20 and, secondly, an upper armoured turret superstructure 24, which connects to the vehicle body.

Figure 2:
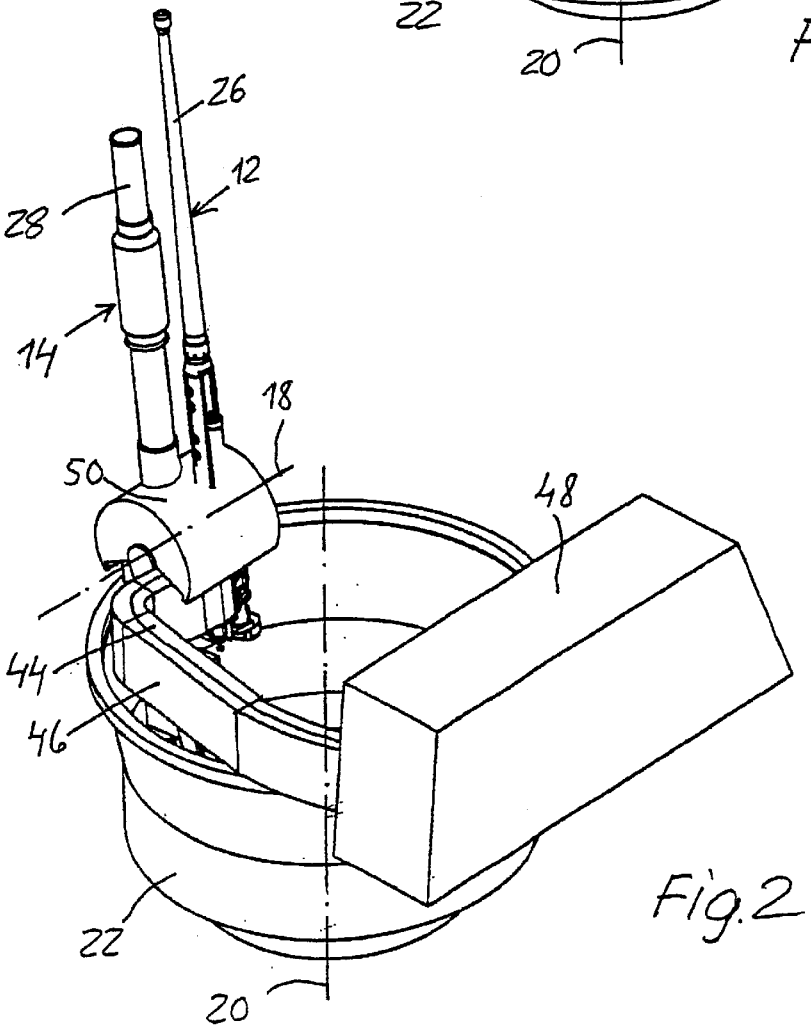
FIG. 2 is a partially broken-open view similar to FIG. 1, but with the barrels at a maximum elevation of ca. 85°.
Figure 4:
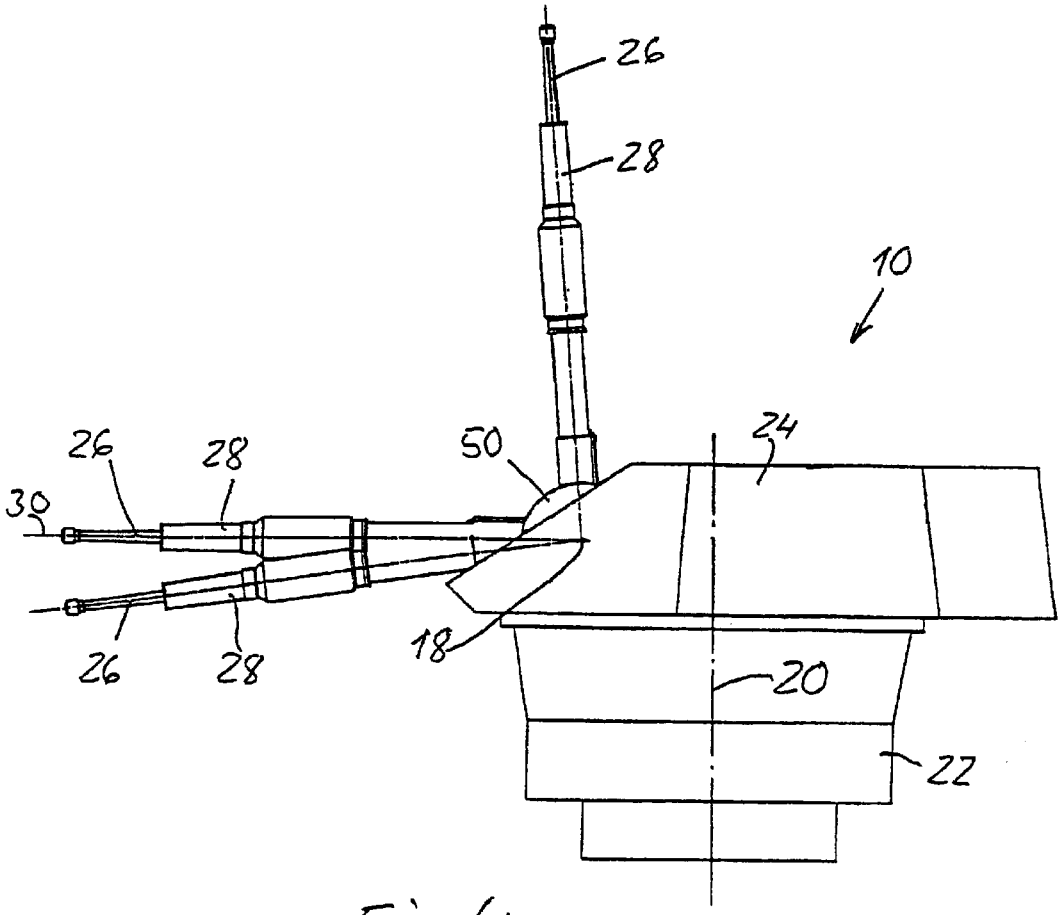
FIG. 4 is a side view of the weapon turret according to the invention.

In the state shown in FIG. 1, the barrels 26 and 28 of the two weapons 12 and 14 respectively assume an elevation of 0°, whilst in FIG. 2 the barrels 26, 28 have been pivoted about the axis 18 to an elevation of ca. +85°. This is also shown in side view in FIG. 4. The barrels 26, 28 can also assume a somewhat downward-pointing position, depending on the configuration of the vehicle body. For example, an elevation of at least ca. −8° is able to be assumed, as shown in FIG. 4.

Figure 3:
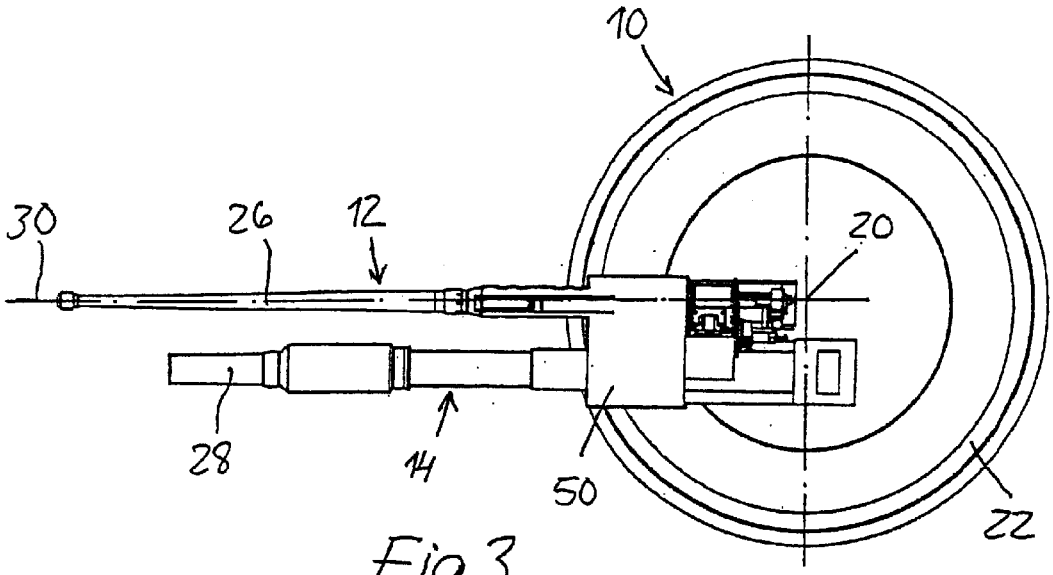
FIG. 3 is a plan view of a part of the weapon turret according to the invention.

As shown in greater detail in FIG. 3, the automatic cannon 12 is fitted in the weapon holder such that the longitudinal axis 30 of the barrel 26 extends through the vertical pivot axis 20 of the weapon turret 10. Accordingly, no torsional shocks are suffered by the weapon turret 10 about the axis 20 during automatic fire, which would otherwise impair the firing accuracy of the automatic cannon in the lateral direction. Improved firing accuracy in the vertical direction is also aided by the fact that the longitudinal axis 30 of the automatic cannon 12 also extends through the horizontal pivot axis 18 for the weapon holder (FIG. 4), no torsional shocks being generated about this axis, which would otherwise disturb the firing accuracy in the vertical direction during automatic fire. Preferably, the weapons 12, 14 are mounted in the weapon holder such that their common centre of gravity ends up on the pivot axis 18, thereby facilitating maneuvering of the weapons 12, 14 into the desired position.

The shell launcher 14 (or cannon) is fitted close up to and next to the automatic cannon 12 and has its barrel 28 directed parallel with the barrel 26 of the automatic cannon 12. Despite the somewhat asymmetrical fitting of the shell launcher 14 (cannon), its firing accuracy is not affected, since the barrel 28 has no time to move in the lateral direction during the brief period in which the item of ammunition is present therein during firing but manages to return to the firing position before the next shot is due to be discharged.

Figure 5:
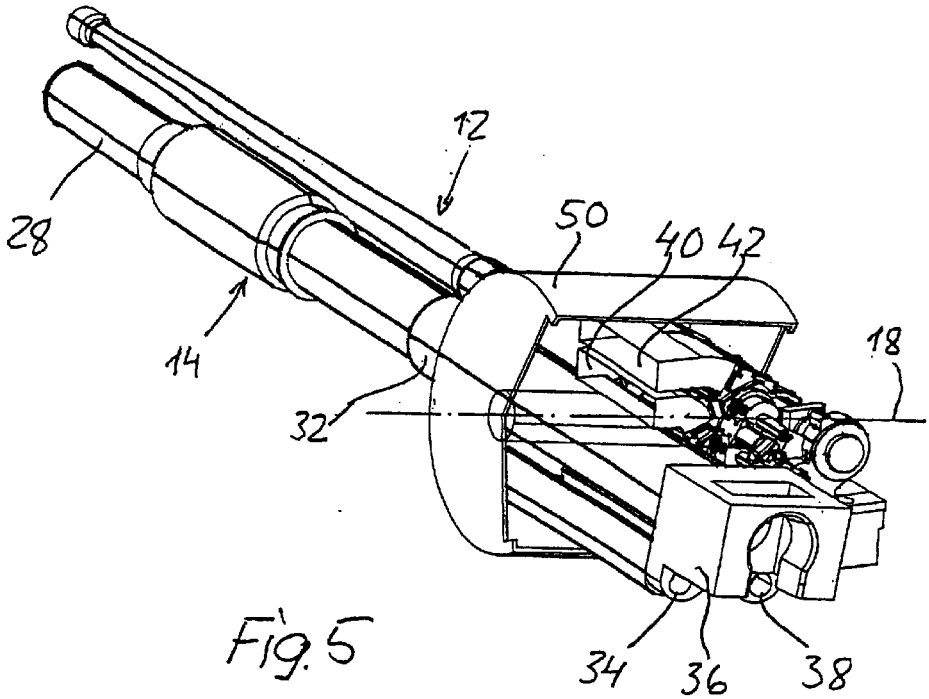
FIG. 5 is a perspective view of the weapons of different calibres mounted pivotably about a common horizontal pivot pin.
Figure 6:
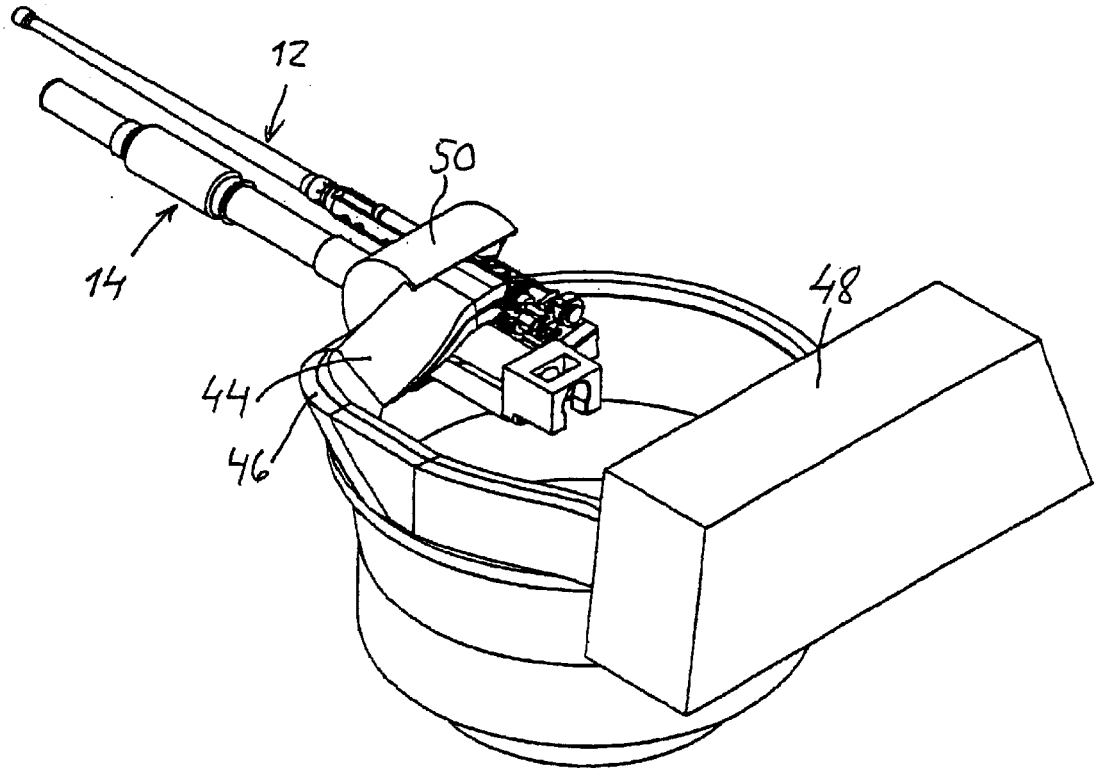
FIG. 6 is a view similar to FIG. 2, but with an elevation of 0°.

As can be seen from FIG. 5, the barrel 28 of the shell launcher 14 is mounted such that it is axially displaceable in a casing tube 32 fixed in the weapon holder. A recoil brake 34 is connected to the casing tube 32 and to a back piece 36 on the rear end of the barrel 28 and is placed on the bottom side of the rear part of the shell launcher 14. An advance mechanism 38, which returns the barrel 28 to its front position following absorption of the recoil after firing, is likewise connected to the casing tube 32 and to the back piece 36 on the bottom side of the rear part of the shell launcher 14. Fixed to the top side of the casing tube 32 are a pair of ammunition guides 40, 42, which have a curvature following the cylindrical outer side of the casing tube 32 and lead to the ammunition intake of the automatic cannon 12. These fixed ammunition guides 40, 42 are placed entirely behind the horizontal pivot axis 18, resulting in minimal vertical motions of the ammunition intake as the automatic cannon 12 is elevated. This placement of the fixed ammunition guides 40, 42 further facilitates the connection of flexible ammunition feed ducts 44, 46 to the automatic cannon 12 (see FIGS. 2 and 6), which ducts extend along one side in the turret superstructure 24 from a rear-situated magazine 48 and allow a rotational and curving motion necessary for a 90° elevation motion of the automatic cannon, as well as motions in the axial direction of the ducts 44, 46. The described placement of fixed ammunition guides 40, 42 on the top side of the casing tube 32 and on the opposite side of this to the recoil brake 34 and the advance mechanism 38 helps to keep the diameter of a so-called weapon drum 50, surrounding the weapon holder, small and helps simultaneously to permit a wide range of elevation of the weapons 12, 14 in a relatively compact weapon turret. In FIGS. 2, 6, the ammunition is fed in upright position from the magazine 48, but it can also be stored and fed horizontally. The inlets of the fixed guides 40, 42 can alternatively be inclined at an angle of about half the elevation angle range relative to the longitudinal axis of the barrel 26 in order to reduce rotation of the ducts during normal elevations.

The weapon turret 10 is provided with a gyro-stabilizing mechanism (not shown), which makes it possible to fire at targets when the vehicle is in motion.

What is claimed is:

1. A weapon turret (10) intended for a military vehicle and equipped with a medium-calibre automatic weapon (12) and a relatively heavy-calibre weapon (14) in which the two weapons (12, 14) are, firstly, mounted in a weapon holder, fitted in the weapon turret (10), such that they can be jointly pivoted about a common horizontal pivot axis (18) and, secondly, can be pivoted jointly with the turret (10) about a vertical centre axis (20) of the same, the heavy-calibre weapon (14) being mounted next to and parallel with the automatic weapon (12), and in which at least one ammunition magazine (48) in the weapon turret is provided with at least one guide duct (44, 46) for guiding an ammunition belt from the magazine (48) to the automatic weapon (12), characterized in that the automatic weapon (12) is mounted in the weapon holder such that the longitudinal axis (30) of the barrel (26) of the automatic weapon extends through the common horizontal pivot axis (18) and through the vertical centre axis (20) of the weapon turret.

2. Weapon turret according to claim 1, characterized in that the two weapons (12, 14) are jointly pivotable about the horizontal pivot axis (18) in the weapon holder within a range of elevation of ca. −10° to +85°.

3. Weapon turret according to claim 1, characterized in that the two weapons (12, 14) are mounted in the weapon holder such that their common centre of gravity lies on the horizontal pivot axis (18).

4. Weapon turret according to claim 1, in which the heavy-calibre weapon (14) is displaceably mounted in a casing tube (32) in the weapon holder and connected to a recoil damper (34) and an advance mechanism (38), characterized in that the recoil damper (34) and the advance mechanism (38) are fitted on the bottom side of the casing tube (32), whilst on the top side of this there is fixedly disposed at least one ammunition guide (40, 42), which follows the curvature of the top side of the casing tube (32) and leads forward to an ammunition intake in the adjoining automatic weapon (12).

5. Weapon turret according to claim 4, characterized in that an ammunition guide duct (44, 46), which is axially expandable and is flexible in every plane, is connected to an inlet of the respective fixed ammunition guide (40, 42).

6. Weapon turret according to claim 5, characterized in that the ammunition magazine (48) is fitted behind the weapons (12, 14) in the weapon turret (10) and in that the flexible ammunition guide duct (44, 46) extends forward from the magazine and is curved such that ammunition in the flexible guide duct (44, 46) can be fed in over the casing tube (32) for the heavy-calibre weapon (14) and into the fixed guide (44, 46) with the ammunition lying substantially horizontally with its front end in the firing direction, the barrel (26) of the automatic weapon having an elevation of 0°.

7. Weapon turret according to claim 5, characterized in that the ammunition magazine (48) is fitted behind the weapons (12, 14) in the weapon turret (10) and in that the flexible ammunition guide duct (44, 46) extends forward from the magazine and is curved such that ammunition in the flexible guide duct can be fed in over the casing tube (32) for the heavy-calibre weapon (14) and into the fixed guide with the ammunition inclined at an angle corresponding to about half the total elevation angle range relative to the barrel (26) of the automatic weapon.

8. Weapon turret according to claim 5, characterized in that the fixed guide (40, 44) is placed on the casing tube (32) of the heavy-calibre weapon close up to the horizontal pivot axis (18) and on the side thereof which is facing away from the muzzle of the weapon.

9. Weapon turret according to claim 2, characterized in that the two weapons (12, 14) are mounted in the weapon holder such that their common centre of gravity lies on the horizontal pivot axis (18).

10. Weapon turret according to claim 2, in which the heavy-calibre weapon (14) is displaceably mounted in a casing tube (32) in the weapon holder and connected to a recoil damper (34) and an advance mechanism (38), characterized in that the recoil damper (34) and the advance mechanism (38) are fitted on the bottom side of the casing tube (32), whilst on the top side of this there is fixedly disposed at least one ammunition guide (40, 42), which follows the curvature of the top side of the casing tube (32) and leads forward to an ammunition intake in the adjoining automatic weapon (12).

11. Weapon turret according to claim 3, in which the heavy-calibre weapon (14) is displaceably mounted in a casing tube (32) in the weapon holder and connected to a recoil damper (34) and an advance mechanism (38), characterized in that the recoil damper (34) and the advance mechanism (38) are fitted on the bottom side of the casing tube (32), whilst on the top side of this there is fixedly disposed at least one ammunition guide (40, 42), which follows the curvature of the top side of the casing tube (32) and leads forward to an ammunition intake in the adjoining automatic weapon (12).

12. Weapon turret according to claim 9, in which the heavy-calibre weapon (14) is displaceably mounted in a casing tube (32) in the weapon holder and connected to a recoil damper (34) and an advance mechanism (38), characterized in that the recoil damper (34) and the advance mechanism (38) are fitted on the bottom side of the casing tube (32), whilst on the top side of this there is fixedly disposed at least one ammunition guide (40, 42), which follows the curvature of the top side of the casing tube (32) and leads forward to an ammunition intake in the adjoining automatic weapon (12).

13. Weapon turret according to claim 6, characterized in that the fixed guide (40, 44) is placed on the casing tube (32) of the heavy-calibre weapon close up to the horizontal pivot axis (18) and on the side thereof which is facing away from the muzzle of the weapon.

14. Weapon turret according to claim 6, characterized in that the fixed guide (40, 44) is placed on the casing tube (32) of the heavy-calibre weapon close up to the horizontal pivot axis (18) and on the side thereof which is facing away from the muzzle of the weapon.

15. Weapon on claim 1, wherein the medium-calibre weapon is an automatic cannon.

16. Weapon of claim 1, wherein the heavy-calibre weapon is one of a shell launcher and a cannon.

17. Weapon of claim 1, wherein the medium-calibre weapon is an automatic canon, and the heavy-caliber weapon is one of a shell launcher and a cannon.

* * * * *